US005329203A

United States Patent [19]

Jeong

[11] Patent Number: 5,329,203

[45] Date of Patent: Jul. 12, 1994

[54] FLAT COLD CATHODE FLUORESCENT LAMP WITH IMPROVED LUMINANCE

[75] Inventor: Eui-seon Jeong, Kyunggi, Rep. of Korea

[73] Assignee: Samsung Electron Devices Co., Ltd., Kyunggi, Rep. of Korea

[21] Appl. No.: 882,974

[22] Filed: May 14, 1992

[30] Foreign Application Priority Data

Sep. 25, 1991 [KR] Rep. of Korea ..... 91-15710

[51] Int. Cl.[5] ..... H01J 1/62

[52] U.S. Cl. ..... 313/491; 313/492; 313/485; 313/631; 313/306

[58] Field of Search ..... 313/485, 491, 492, 581, 313/582, 631, 306, 307

[56] References Cited

U.S. PATENT DOCUMENTS 4,767,965 8/1988 Yamano et al. ..... 313/491
4,780,644 10/1988 Sakai et al. ..... 313/582
5,138,225 8/1992 Kim ..... 313/492

FOREIGN PATENT DOCUMENTS 0196447 8/1991 Japan ..... 313/582

*Primary Examiner*—Donald J. Yusko
*Assistant Examiner*—Nimesh Patel
*Attorney, Agent, or Firm*—Leydig Voit & Mayer

[57] ABSTRACT

A flat cold cathode fluorescent lamp include front and rear plates separated by spacers. A phosphor layer is formed on each upper side of a spacer in contact with a phosphor layer of the front plate, and an auxiliary electrode is provided lengthwise on each lower side of the spacer, thereby realizing uniformly luminous pictures.

6 Claims, 4 Drawing Sheets

FLAT COLD CATHODE FLUORESCENT LAMP WITH IMPROVED LUMINANCE

BACKGROUND OF THE INVENTION

The present invention relates to a flat cold cathode fluorescent lamp, and more particularly to a flat cold cathode fluorescent lamp which improves luminance in the vicinity of a spacer.

Generally, a flat cold cathode fluorescent lamp is used as a backlight generator for a large liquid crystal display.

Referring to FIGS. 1, 2 and 3, in a conventional flat cold cathode fluorescent lamp, phosphor layers 1*a* and 2*a* are formed on the opposing inner surfaces of parallel front and rear plates 1 and 2, respectively. A side plate 3 is provided on the periphery between front and rear plates 1 and 2 to form a closed discharge space where discharge gas is filled. A pair of electrodes 4 are provided adjacent to side plate 3 in the closed discharge space. A plurality of spacers 5' for supporting front and rear plates 1 and 2 are also provided in the closed discharge space. A phosphor layer 5*a'* connected to phosphor layer la on front plate 1 is formed on the side of spacer 5'.

In the conventional flat cold cathode fluorescent lamp, to enhance the luminance around spacer 5' supporting front and rear plates 1 and 2, phosphor layer 5*a'* is formed on spacer 5' to be connected to phosphor layer la formed on front plate 1. During the discharge of electrode 4, phosphor layer 5*a'* formed on spacer 5' emits light which makes the part of phosphor layer 1*a* around spacer 5' luminous, thereby preventing the luminance around the spacers from lowering. In a large-sized flat cold fluorescent lamp, however, since the amount of light transmitted from phosphor layer 5*a'* formed on the side of spacer 5' to phosphor layer 1*a* around the spacers is small, the luminance in the vicinity of the spacers is degraded to cause the picture to smear.

SUMMARY OF THE INVENTION

Therefore, it is an object of the present invention to provide a flat cold cathode fluorescent lamp which is improved to prevent smears in a picture caused due to the degradation of luminance around spacers.

To accomplish the object, the flat cold cathode fluorescent lamp of the present invention comprises a front plate having a phosphor layer on the inner surface thereof, a rear plate having a phosphor layer on the inner surface thereof, spacers placed between the front and rear plates for their support, side plates provided on the periphery between the front and rear plates, and main electrodes placed lengthwise on the opposing inner surface of the side plates, perpendicular to the spacers, wherein a phosphor layer is formed on each upper side of the spacer in contact with the phosphor layer of the front plate and an auxiliary electrode is provided lengthwise on each lower side of the spacer.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
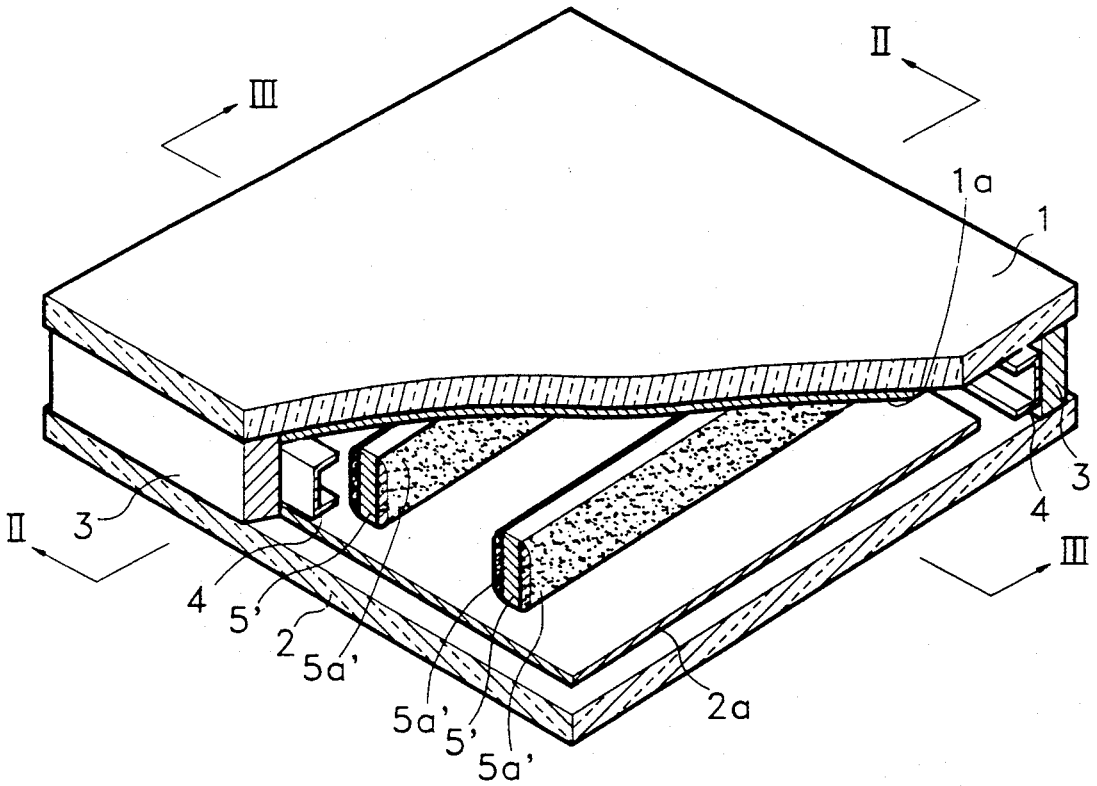
FIG. 1 (PRIOR ART)
FIG. 1 s a cutaway perspective of a conventional flat cold cathode fluorescent lamp.
Figure 2:
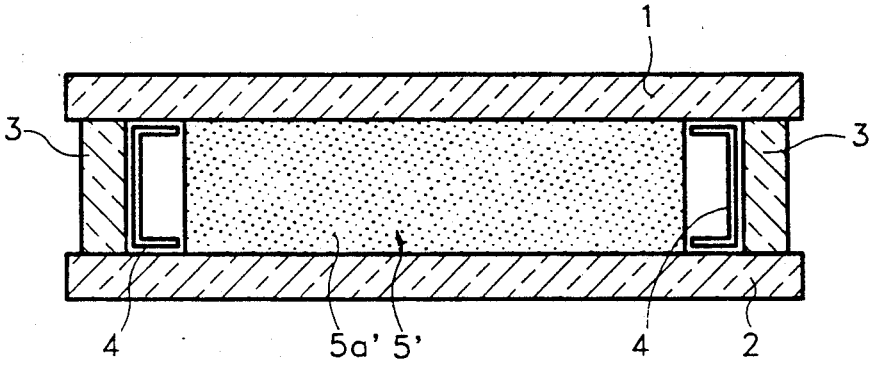
FIG.2(PRIOR ART)
FIG. 2 is a sectional view cut along line II—II in FIG. l.
Figure 3:
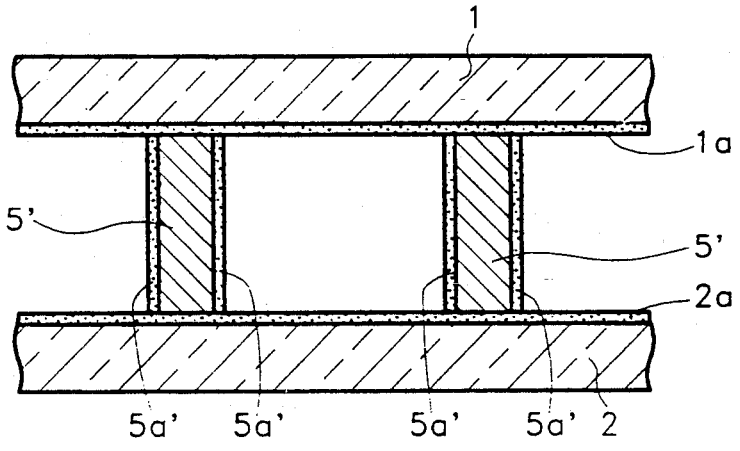
FIG.3(PRIOR ART)
FIG. 3 is a sectional view cut along line III—III in FIG. l.
Figure 4:
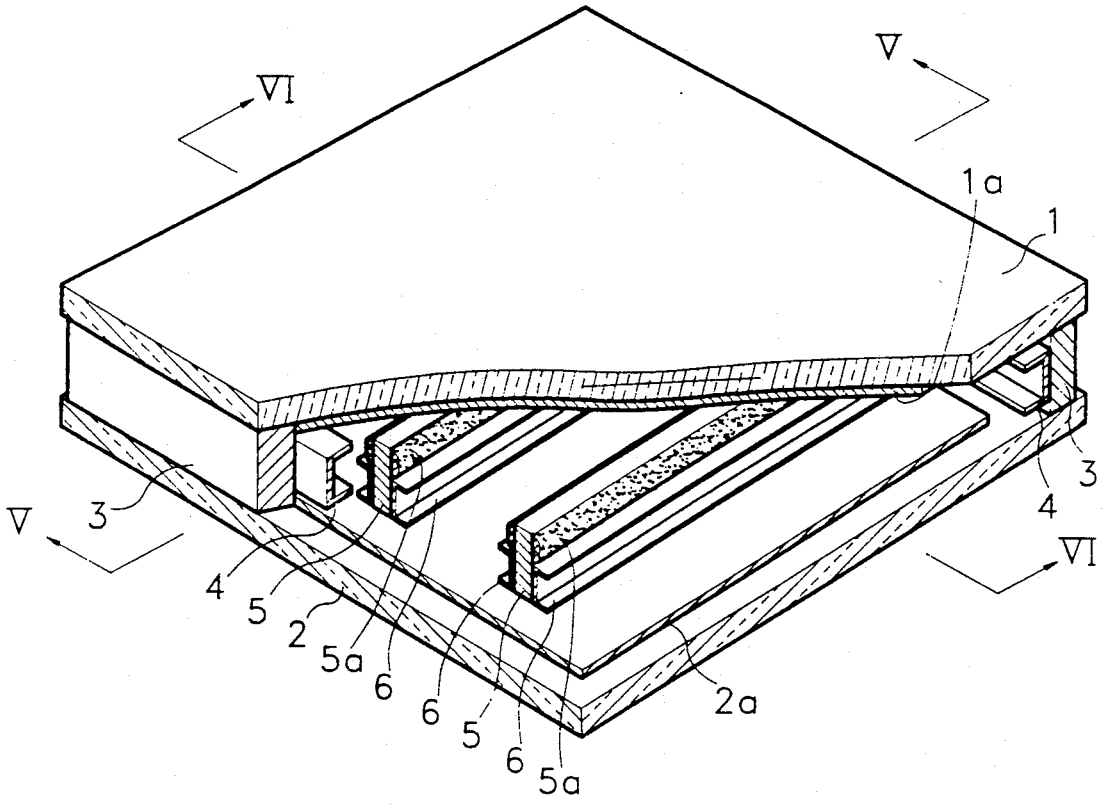
FIG. 4 is a cutaway perspective of a flat cold cathode fluorescent lamp according to the present invention.
Figure 5:
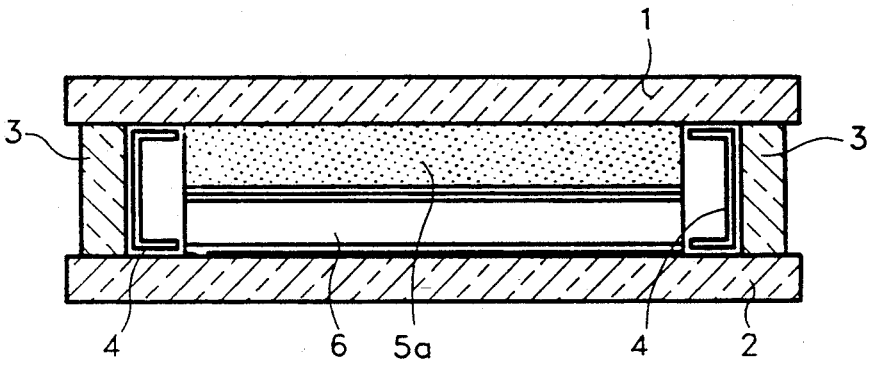
FIG. 5 is a sectional view cut along line V—V in FIG. 4.
Figure 6:
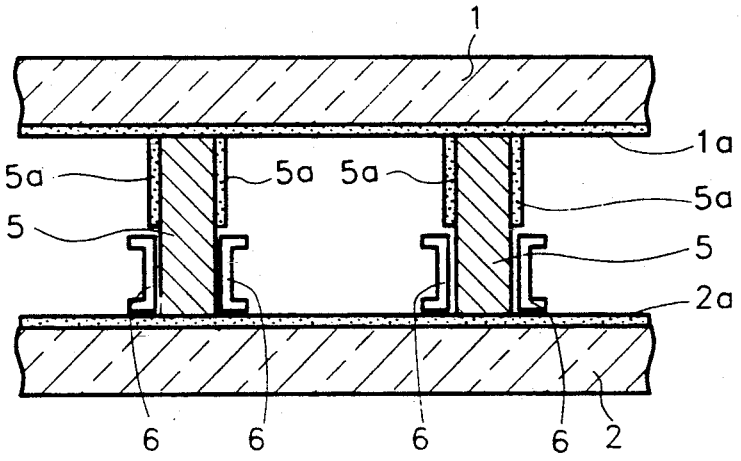
FIG. 6 is a sectional view cut along line VI—VI in FIG. 4.

Referring to FIG. 4, in a flat cold cathode fluorescent lamp according to the present invention, phosphor layers 1*a* and 2*a* are formed on the opposing inner surfaces of parallel front and rear plates 1 and 2 spaced apart by a predetermined distance from each other, respectively. A side plate 3 is provided on the periphery between front and rear plates 1 and 2 to form a closed discharge space where discharge gas is filled. A pair of main electrodes 4 are provided adjacent to side plate 3 in the closed discharge space. A plurality of spacers 5 for supporting front and rear plates 1 and 2 are also provided in the closed discharge space in the perpendicular direction of main electrodes 4. Here, according to a feature of the present invention, a phosphor layer 5*a* is formed on the upper side of spacer 5 in contact with phosphor layer 1*a*. An auxiliary electrode 6 is provided on the lower side of spacer 5 in contact with phosphor layer 2*a*.

The flat cold cathode fluorescent lamp of the present invention emits light according to the discharge of main electrode 4 in the same fashion as the conventional one. Since a phosphor layer 5*a* in contact with phosphor layer 1*a* formed on front plate 1 is formed on the upper side of spacer 5 and an auxiliary electrode 6 is formed on the lower side of spacer 5, phosphor layer 5*a* formed on spacer 5 receives secondary illumination from auxiliary electrode 6 and therefore the amount of light transmitted to the phosphor layer around the spacers increases as compared with the conventional lamp, minimizing picture smears due to low luminance around the spacers.

As described above in detail, by providing the auxiliary electrode for illuminating the phosphor layer around the spacers on the lower side of the spacers, the flat cold cathode fluorescent lamp of the present invention reduces local luminance deviation of a picture caused by low luminance around the spacers, thereby realizing uniformly luminous pictures.

What is claimed is:

1. A flat cold cathode fluorescent lamp comprising:

a front plate having a phosphor layer on an inner surface thereof;

a rear plate having a phosphor layer on an inner surface thereof;

spacers placed between said front and rear plates for their support;

side plates provided between said front and rear plates disposed at the periphery of said front plate and said rear plate, said side plates having opposing inner surfaces; and main electrodes placed lengthwise on the opposing inner surface of said side plates and perpendicular to said spacers, wherein a phosphor layer is formed on an upper side of each of said spacers in contact with the phosphor layer of said front plate and an auxiliary electrode is provided lengthwise on each lower side of said spacer.

2. A flat cold cathode fluorescent lamp as claimed in claim 1, wherein at least one of said main and auxiliary electrodes has a U shape.

3. A flat cold cathode fluorescent lamp comprising:

a front plate having an inner surface;

a phosphor layer disposed on the inner surface of said front plate;

a rear plate having an inner surface, the inner surface of said front plate opposing the inner surface of said rear plate;

a phosphor layer disposed on the inner surface of said rear plate;

a plurality of spacers placed between said front and rear plates, each spacer including a side wall having an upper portion and a lower portion, the upper portion having a phosphor layer disposed thereon and a lower portion having an auxiliary electrode disposed thereon;

side plates connecting said front and rear plates at respective peripheries, said side plates having inner surfaces; and opposing main electrodes contiguous and parallel to the inner surfaces of said side plates.

4. A flat cold cathode fluorescent lamp as claimed in claim 3, wherein the phosphor layers disposed on said spacers are contiguous to the phosphor layer disposed on the inner surface of said front plate.

5. A flat cold cathode fluorescent lamp as claimed in claim 3, wherein the auxiliary electrodes are contiguous to the phosphor layer disposed on said rear plate.

6. A flat cold cathode fluorescent lamp comprising:

a front plate having an inner surface;

a first phosphor layer disposed on the inner surface of said front plate;

a rear plate having an inner surface, the inner surface of said front plate opposing the inner surface of said rear plate;

a second phosphor layer disposed on the inner surface of said rear plate;

a plurality of spacers placed between said front and rear plates, each spacer including first and second side walls, each side wall having a phosphor layer and an auxiliary anode disposed thereon;

side plates connecting said front and rear plates at respective peripheries, said side plates having inner surfaces;

opposing main electrodes contiguous and parallel to the inner surfaces of said side plates.

* * * * *